US009017036B2

(12) United States Patent
Straccia

(10) Patent No.: US 9,017,036 B2
(45) Date of Patent: Apr. 28, 2015

(54) HIGH ORDER SHAPED CURVE REGION FOR AN AIRFOIL

(75) Inventor: Joseph C. Straccia, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 581 days.

(21) Appl. No.: 13/454,316

(22) Filed: Apr. 24, 2012

(65) Prior Publication Data

US 2013/0224040 A1 Aug. 29, 2013

Related U.S. Application Data

(60) Provisional application No. 61/605,019, filed on Feb. 29, 2012.

(51) Int. Cl.
*F01D 5/14* (2006.01)
*F01D 5/20* (2006.01)

(52) U.S. Cl.
CPC *F01D 5/141* (2013.01); *F01D 5/20* (2013.01); *F05D 2240/307* (2013.01); *Y10S 416/02* (2013.01); *Y10S 416/05* (2013.01)

(58) Field of Classification Search
CPC ..... F01D 5/141; F01D 5/20; F05D 2240/307
USPC ..... 416/223 R, 228, 235, 242, 243, 223 A, 416/DIG. 2, DIG. 5
See application file for complete search history.

(56) References Cited

U.S. PATENT DOCUMENTS

| | | | | |
|---|---|---|---|---|
| 4,880,355 | A | 11/1989 | Vuillet et al. | |
| 4,979,698 | A | 12/1990 | Lederman | |
| 5,137,427 | A | 8/1992 | Shenoy | |
| 5,332,362 | A | 7/1994 | Toulmay et al. | |
| 5,642,985 | A * | 7/1997 | Spear et al. | 416/238 |
| 5,685,696 | A | 11/1997 | Zangeneh et al. | |
| 5,947,683 | A * | 9/1999 | Kobayashi | 415/208.1 |
| 5,992,793 | A | 11/1999 | Perry et al. | |
| 6,899,526 | B2 * | 5/2005 | Doloresco et al. | 416/238 |
| 6,901,873 | B1 | 6/2005 | Lang et al. | |
| 6,976,829 | B2 | 12/2005 | Kovalsky et al. | |
| 7,207,526 | B2 | 4/2007 | McCarthy | |
| 7,246,998 | B2 | 7/2007 | Kovalsky et al. | |
| 7,252,479 | B2 | 8/2007 | Bagai et al. | |
| 7,264,200 | B2 | 9/2007 | Bussom et al. | |
| 7,726,937 | B2 * | 6/2010 | Baumann et al. | 415/191 |
| 7,967,571 | B2 | 6/2011 | Wood et al. | |
| 8,684,698 | B2 * | 4/2014 | Breeze-Stringfellow et al. | 416/243 |
| 8,702,398 | B2 * | 4/2014 | Breeze-Stringfellow et al. | 416/242 |
| 2010/0054946 | A1 | 3/2010 | Orosa et al. | |
| 2010/0150729 | A1 | 6/2010 | Kirchner et al. | |

FOREIGN PATENT DOCUMENTS

| | | | |
|---|---|---|---|
| EP | 1905952 | A2 | 4/2008 |
| WO | 2007086908 | A2 | 8/2007 |
| WO | 2012134833 | | 10/2012 |
| WO | 2012134835 | | 10/2012 |

OTHER PUBLICATIONS

International Search Report and Written Opinion for International Application No. PCT/US2013/026543 completed on Nov. 8, 2013.
International Preliminary Report on Patentability for PCT Application for PCT/US2013/026543 mailed Sep. 12, 2014.

* cited by examiner

*Primary Examiner* — Igor Kershteyn
(74) *Attorney, Agent, or Firm* — Carlson, Gaskey & Olds. P.C.

(57) ABSTRACT

A turbomachine blade with a localized dihedral feature has a high order polynomial shaped curve region.

31 Claims, 5 Drawing Sheets

HIGH ORDER SHAPED CURVE REGION FOR AN AIRFOIL

REFERENCE TO RELATED APPLICATIONS

The present application claims priority to U.S. Provisional Patent Application No. 61/605,019, filed Feb. 29, 2012.

TECHNICAL FIELD

The present disclosure is related in general to airfoils for use in turbine machines, and in particular to airfoils incorporating localized high order dihedral.

BACKGROUND OF THE INVENTION

Turbine machines, such as turbofan gas turbine engines or land based turbine generators, typically include a compressor section, a combustor section and a turbine section. During operation, air is pressurized in the compressor section and mixed with fuel in the combustor section for generating hot combustion gases. The hot combustion gases flow through the turbine section which extracts energy from the hot combustion gases to power the compressor section and in the case of turbine generators, drive the turbine power shaft.

Many turbine machines include axial-flow type compressor sections in which the flow of compressed air is parallel to an engine centerline axis. Axial-flow compressors may utilize multiple stages to obtain the pressure levels needed to achieve desired thermodynamic cycle goals. A typical compressor stage consists of a row of rotating airfoils (called rotor blades) and a row of stationary airfoils (called stator vanes).

One design feature of an axial-flow compressor section that affects compressor performance and stability is tip clearance flow. A small gap extends between the tip of each rotor blade airfoil and a surrounding shroud in each compressor stage. Tip clearance flow is defined as the flow of fluid between the rotor tip and an outer shroud from the high pressure side (pressure side) to the low pressure side (suction side) of the rotor blade. Tip clearance flow reduces the ability of the compressor section to sustain pressure rise, increases losses and may have a negative impact on stall margin (i.e., the point at which the compressor section can no longer sustain an increase in pressure such that the gas turbine engine stalls).

At the airfoil tip in the region where the airfoil and its boundary layer interact with the endwall boundary layer and the tip leakage flow, the aerodynamic loading tends to be higher than at the airfoil midspan. High aerodynamic loading results in higher turning deviation, larger losses and an increased likelihood of boundary layer separation. Bulk separation of the boundary layer on rotor tips is one mechanism for compressor stall.

SUMMARY OF THE INVENTION

In one non-limiting disclosed embodiment, a turbomachine blade has: an airfoil extending along a spanwise stacking distribution between a root and a tip region, the airfoil including a chordline extending between a leading edge and a trailing edge; and a dihedral feature of the spanwise stacking distribution, wherein the dihedral feature is generally localized at an end of the spanwise stacking distribution, the dihedral feature being further defined by a curved region of the spanwise stacking distribution of the airfoil, a shape of the curved region being defined by a high order polynomial.

In a further embodiment of any of the above examples, the high order polynomial is defined by a polynomial having the polynomial term $A*(Z-Z_{blend})^n$ where, A is a constant, Z is a radial location of the spanwise stacking distribution section, $Z_{blend}$ is a radial location for a blend point of the spanwise stacking distribution, and n is the order of the polynomial.

In a further embodiment of any of the above examples, the high order polynomial is defined by $\Delta y'=A*(Z-Z_{blend})^n$.

In a further embodiment of any of the above examples, n is greater than or equal to 2.1.

In a further embodiment of any of the above examples, n is greater than or equal to 3.

In a further embodiment of any of the above examples, the curve region is a region of the airfoil where the spanwise stacking distribution of the airfoil diverges from the radial airfoil stacking line.

In a further embodiment of any of the above examples, the airfoil has a blend point where the curve region initially diverges from the radial airfoil stacking line.

In a further embodiment of any of the above examples, the blend point is at least at 70% of the span.

In a further embodiment of any of the above examples, the blend point is at least at 80% of the span.

In a further embodiment of any of the above examples, the dihedral angle is in the range of 15 degrees to 35 degrees.

In a further embodiment of any of the above examples, the airfoil is a rotor blade.

In a further embodiment of any of the above examples, the airfoil is a rotor blade in a compressor section of a gas turbine engine.

In a further embodiment of any of the above examples, the airfoil is a stator blade.

In a further embodiment of any of the above examples, the airfoil is a stator blade in a compressor section of a gas turbine engine.

In a further embodiment of any of the above examples, the spanwise stacking distribution extends from a root to a tip of the airfoil, and wherein the spanwise stacking distribution is a curve passing through the centroids of each of multiple stacked planar sections of the airfoil.

In a further embodiment of any of the above examples, the end of the spanwise stacking distribution is a tip region of said airfoil.

In a further embodiment to any of the above examples, the end of the spanwise stacking distribution is a root region of said airfoil.

In a second non-limiting disclosed embodiment, A turbine machine has: a plurality of airfoils wherein each of the airfoils extend along a spanwise stacking distribution between a root and a tip region, the airfoil including a chordline extending between a leading edge and a trailing edge; and a dihedral feature, wherein the dihedral feature is generally localized at an end of the spanwise stacking distribution, the dihedral feature being further defined by a curve region of the spanwise stacking distribution of the airfoil, a shape of the curve region being defined by a high order polynomial.

In a further embodiment of any of the above examples, the high order polynomial is defined by a polynomial comprising the polynomial term $A*(Z-Z_{blend})^n$ where, A is a constant, Z is the radial location of the spanwise stacking distribution section, $Z_{blend}$ is a radial location for a blend point of the spanwise stacking distribution, and n is the order of the polynomial.

In a further embodiment of any of the above examples, the high order polynomial is defined by $\Delta y'=A*(Z-Z_{blend})^n$.

In a further embodiment of any of the above examples, n is greater than or equal to 2.1.

In a further embodiment of any of the above examples, n is greater than or equal to 3.

In a further embodiment of any of the above examples, the curve region is a region of the airfoil where a spanwise stacking distribution diverges from a radial airfoil stacking line.

In a further embodiment of any of the above examples, the turbine blade has a blend point where the curve region initially diverges from the radial airfoil stacking line.

In a further embodiment of any of the above examples, the blend point is at least at 70% of the span.

In a further embodiment of any of the above examples, the blend point is at least at 80% of the span.

In a further embodiment of any of the above examples, the dihedral angle is in the range of 15 degrees to 35 degrees.

In a further embodiment of any of the above examples, the turbine machine is a geared turbofan.

In a further embodiment of any of the above examples, the spanwise stacking distribution extends from a root to a tip of the airfoil, and wherein the spanwise stacking distribution is a curve passing through the centroids of each of multiple stacked planar sections of the airfoil.

In a further embodiment of any of the above examples, the end of the spanwise stacking distribution is a tip region of said airfoil.

In a further embodiment to any of the above examples, the end of the spanwise stacking distribution is a root region of said airfoil.

These and other features of the present invention can be best understood from the following specification and drawings, the following of which is a brief description.

DETAILED DESCRIPTION OF AN EMBODIMENT

Figure 1:
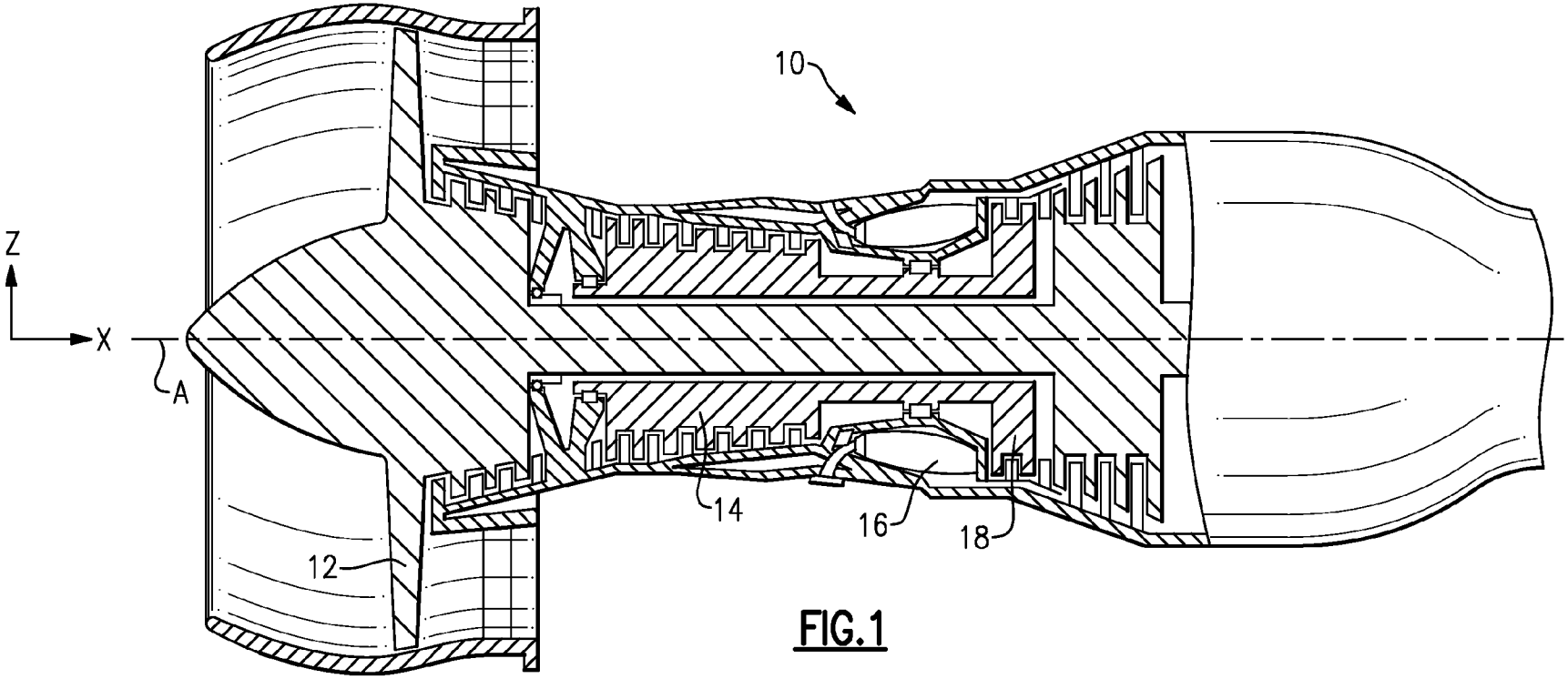
FIG. 1 is a cross-sectional view of an example gas turbine engine.

FIG. 1 illustrates an example gas turbine engine 10 that includes a fan 12, a compressor section 14, a combustor section 16 and a turbine section 18. The gas turbine engine 10 is defined about an engine centerline axis A about which the various engine sections rotate. Air is drawn into the gas turbine engine 10 by the fan 12 and flows through the compressor section 14 to pressurize the airflow. Fuel is mixed with the pressurized air and combusted within the combustor 16. The combustion gases are discharged through the turbine section 18, which extracts energy therefrom for powering the compressor section 14 and the fan 12. Of course, this view is highly schematic. In the illustrated example, the gas turbine engine 10 is a turbofan gas turbine engine. It should be understood, however, that the features and illustrations presented within this disclosure are not limited to a turbofan gas turbine engine. That is, the present disclosure is applicable to any axial flow turbine machine. In an alternate example, the features described herein can also be incorporated in a land based turbine machine such as a gas turbine generator. Some turbine machines do not include a fan section.

Figure 2:
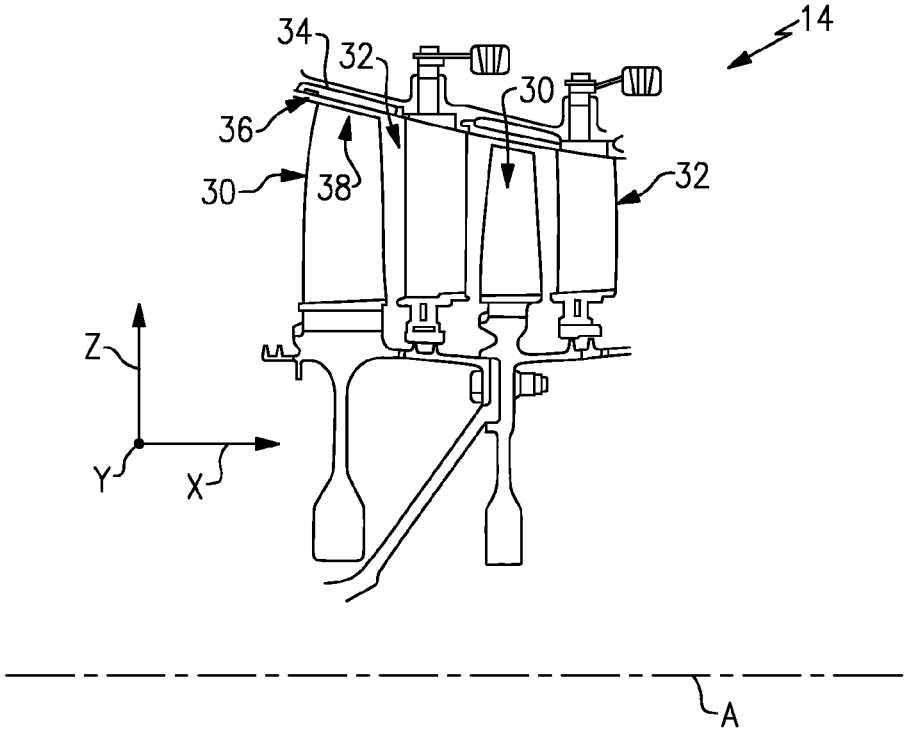
FIG. 2 illustrates a portion of a compressor section of the example gas turbine engine illustrated in FIG. 1.

FIG. 2 schematically illustrates a portion of the compressor section 14 of the gas turbine engine 10. In one example, the compressor section 14 is an axial-flow compressor. Compressor section 14 includes a plurality of compression stages including alternating rows of rotor blades 30 and stator blades 32. The rotor blades 30 rotate about the engine centerline axis A in a known manner to increase the velocity and pressure level of the airflow communicated through the compressor section 14. The stationary stator blades 32 convert the velocity of the airflow into pressure, and turn the airflow in a desired direction to prepare the airflow for the next set of rotor blades 30. The rotor blades 30 are partially housed by a shroud assembly 34 (i.e., an outer case). A gap 36 extends between a tip 38 and shroud 34 of each rotor blade 30 to provide clearance for the rotating rotor blades 30.

Figure 3:
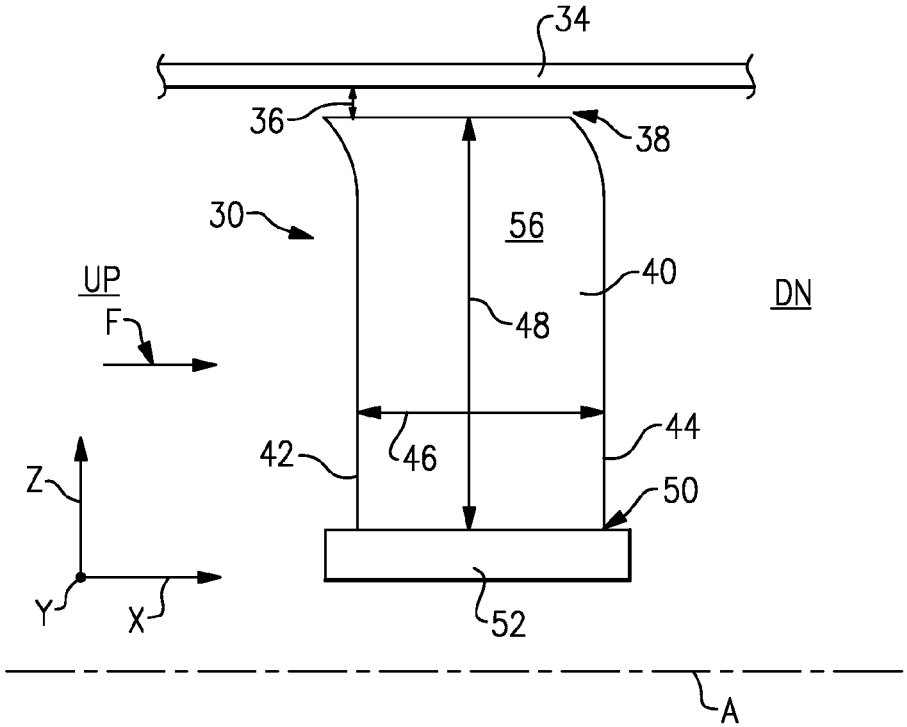
FIG. 3 illustrates a schematic view of an airfoil according to the present disclosure.
Figure 4:
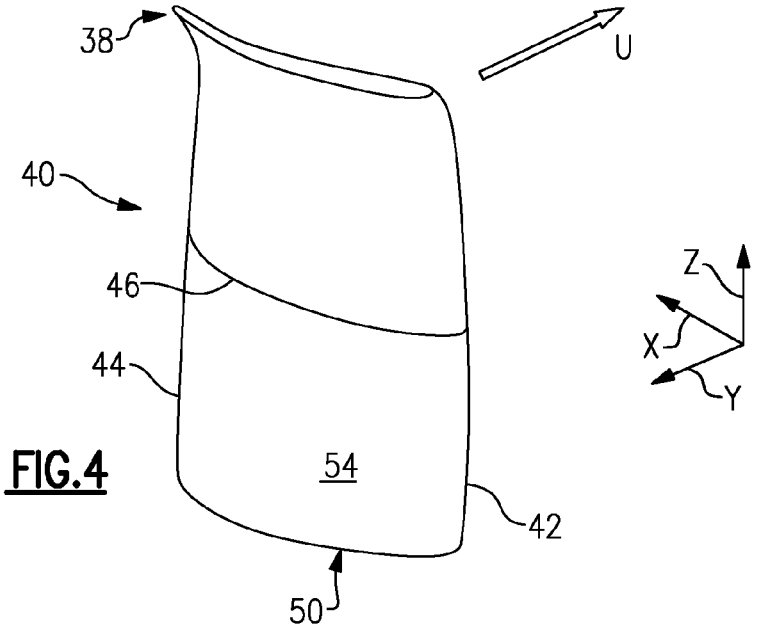
FIG. 4 illustrates another view of the example airfoil illustrated in FIG. 3.

FIGS. 3 and 4 illustrate an example rotor blade 30 that includes design elements localized at the tip 38 for reducing the aerodynamic loading of the airfoil. The rotor blade 30 includes an airfoil 40 having a leading edge 42 and a trailing edge 44. A chord 46 of the airfoil 40 extends between the leading edge 42 and the trailing edge 44. A span 48 of the airfoil 40 extends between a root 50 and the tip 38 of the rotor blade 30. The root 50 of the rotor blade 30 is adjacent to a platform 52 that connects the rotor blade 30 to a rotating drum or disk (not shown) in a known manner. The airfoil 40 also includes a dihedral feature, described in greater detail below. Generally, the dihedral feature refers to a curve region of a spanwise stacking distribution of the airfoil 40.

The airfoil 40 of the rotor blade 30 also includes a suction surface 54 and an opposite pressure surface 56. The suction surface 54 is a generally convex surface and the pressure surface 56 is a generally concave surface. The suction surface 54 and the pressure surface 56 are conventionally designed to pressurize the airflow F as it is communicated from an upstream direction UP to a downstream direction DN. The airflow F flows in a direction having an axial component that is parallel to the longitudinal centerline axis A of the gas turbine engine 10. The rotor blade 30 rotates about the engine centerline axis A.

Figure 5:
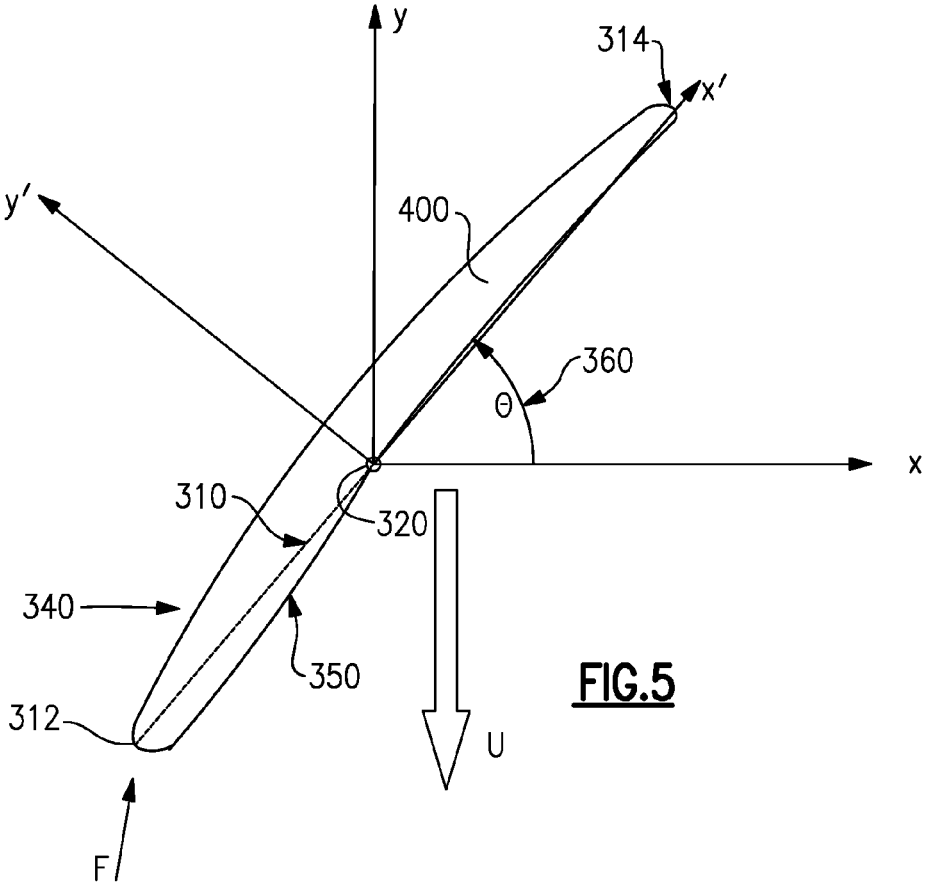
FIG. 5 illustrates a planar view of an airfoil blade.

FIG. 5 illustrates a planar section 400 of the airfoil 30 illustrated in FIG. 4. The airfoil planar section 400 is composed of a leading edge 312, a trailing edge 314, a suction side 340 and a pressure side 350. A chordline 310 extends from the leading edge 312 to the trailing edge 314 of the airfoil planar section 400. A chordline angle 360 is measured between the chordline 310 and the axial direction x. The airfoil planar section 400 has a centroid 320 (such as a center of gravity) that is the center of mass for that planar section. The direction of the incident air at the leading edge 312 of the airfoil planar section 400 is indicated with the vector F.

The airfoil planar section 400 can be positioned in space by the three dimensional location of its centroid 320. A traditional coordinate system, for example where x is parallel to the axis of rotation, z is the radial direction relative to x, and y is tangential to the circumference of rotation, is used to position the airfoil planar section 400. A second coordinate system is defined relative to the airfoil planar section 400 such that the x and y directions are rotated about the z axis by the chordline angle 360 such that the new y' direction is perpendicular to the chordline 310 and the new x' direction is parallel to the chordline 310. This second coordinate system, x', y', z, is referred to as the rotated coordinate system. Alternatively, the x,y,z coordinate system may also be rotated about the z axis by the angle between the inlet air direction F and the x axis to form the rotated coordinate system. The dihedral curve region is applied to the airfoil spanwise stacking distribution in the rotated coordinate system.

Figure 6:
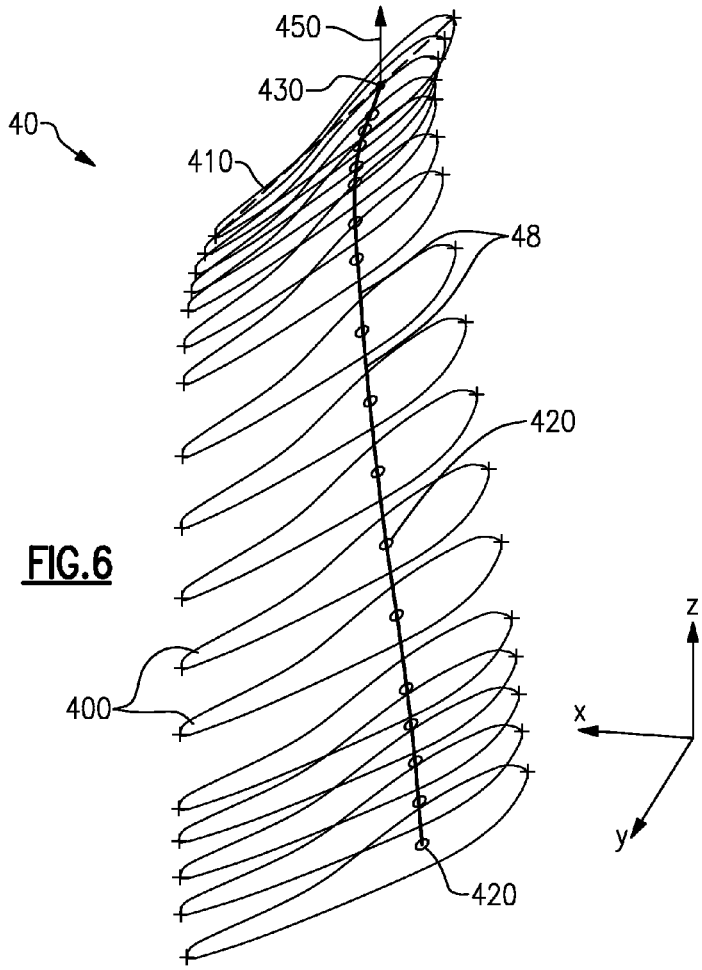
FIG. 6 illustrates a wireframe view of an airfoil blade.

FIG. 6 illustrates a wireframe view of an airfoil 40 composed of several airfoil planar sections, such as the section 400 illustrated in FIG. 5. The centroids 420 of the airfoil planar sections 400 are "stacked" or positioned in space along the spanwise stacking distribution 48 to define the three dimensional shape of the airfoil 40. A radial airfoil with no dihedral is constructed by stacking the airfoil planar sections' centroids 420 in a straight radial line from the hub 420 to the tip 430. To introduce dihedral the stacking location of the airfoil planar section 400 centroid 420 is shifted in the y' direction, normal to the chordline 410. Positive dihedral displaces the airfoil planar section 400 towards the airfoil suction side 340 and away from the airfoil pressure side 350. Positive dihedral may alternatively be defined as the suction side 340 of the airfoil tip producing an obtuse angle with an outer shroud 34.

Figure 7:
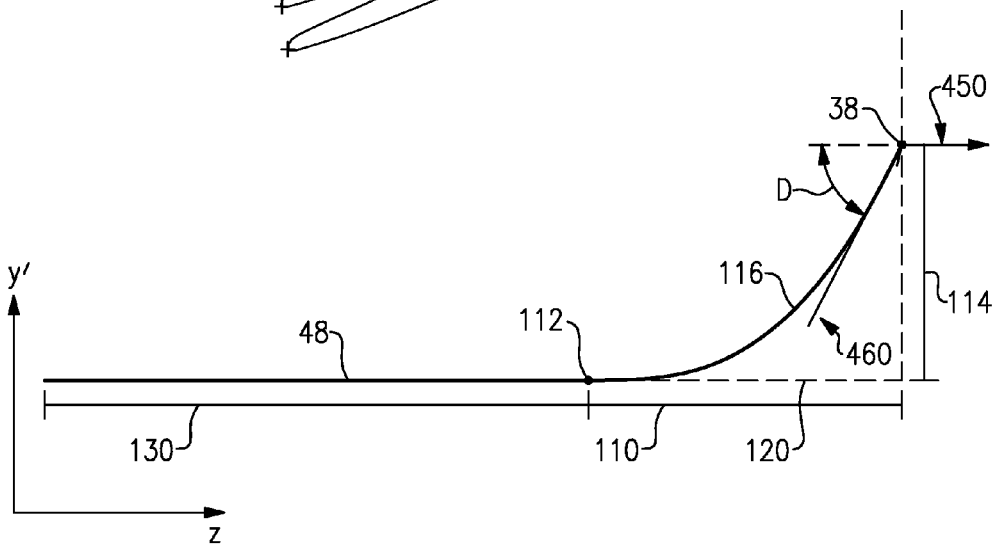
FIG. 7 illustrates an airfoil spanwise stacking distribution including a high order polynomial curve region.
Figure 8:
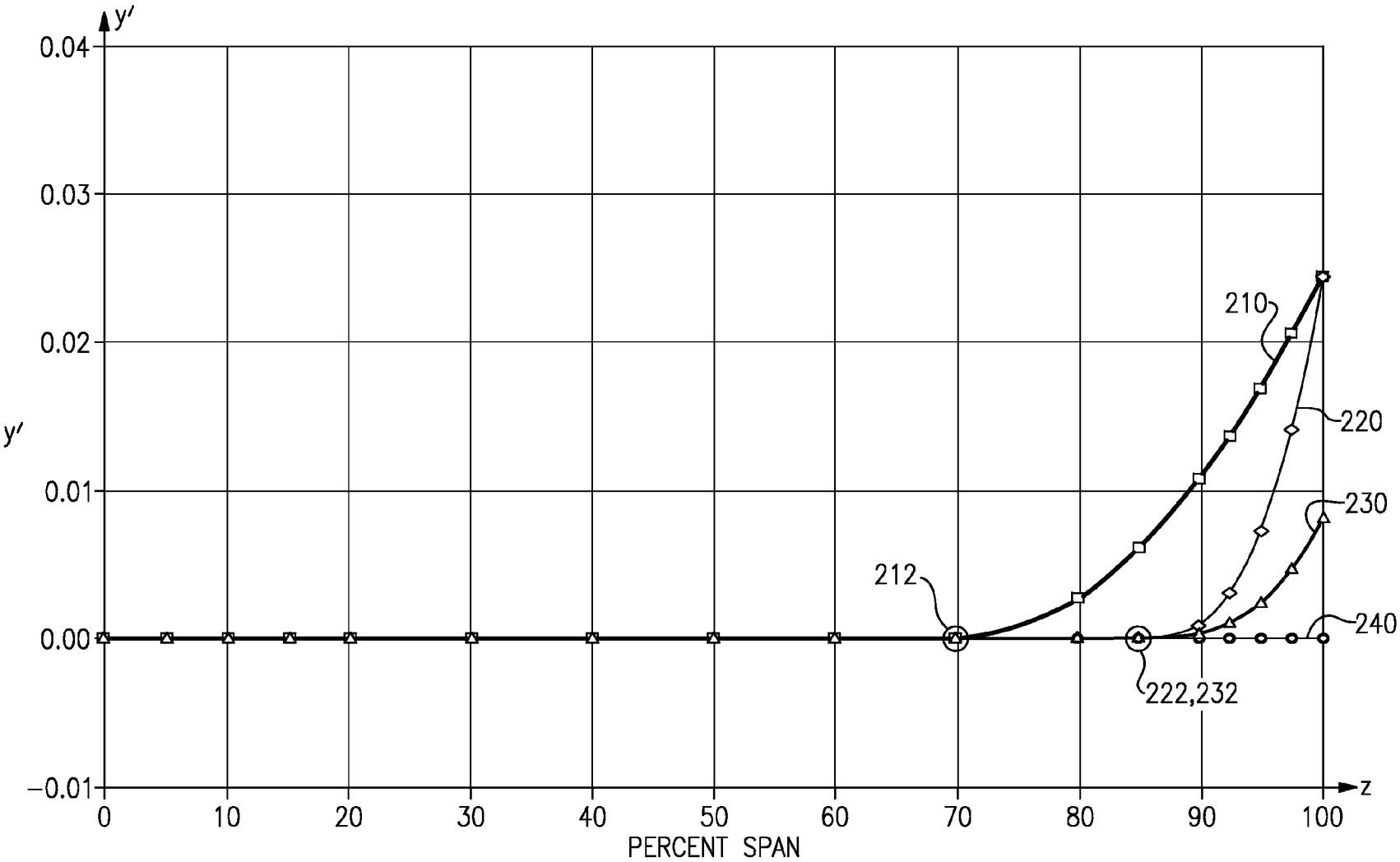
FIG. 8 illustrates a graph relating a tip deflection and a blend point of multiple example airfoils.

With reference to FIGS. 6 and 7 the dihedral angle D is used to quantify the amount of dihedral added to the airfoil 40. The dihedral angle D describes the spatial relationship, in the y' direction, of the airfoil tip planar section 430 relative to the sections below the airfoil tip. The dihedral angle D is measured between two vectors in the rotated coordinate plane y'-z. The first vector is the radial vector 450 projected out of the stacking distribution tip 38. The second vector is a line 460 tangent to the tip 38 of the spanwise stacking distribution 48. The projection of the two vectors into the y'-z plane is shown in FIG. 7 and this plane's relationship to the airfoil planar section 400 is depicted in FIG. 5.

The airfoil 40 includes a dihedral angle D (See FIG. 7) that is localized relative to the tip 38 of the airfoil 40. The term "localized" as utilized in this disclosure is intended to define a dihedral curve region which is restricted to a specific radial portion of the spanwise stacking distribution 48. Although the dihedral angle D and the dihedral stacking shape are disclosed herein with respect to a rotor blade airfoil 40, it should be understood that other components, such as stator blade airfoils, of the gas turbine engine 10 may benefit from similar aerodynamic improvements as those illustrated with respect to the airfoil 40. Although the localized dihedral distribution is disclosed herein with respect to the airfoil tip, it should be understood that the same localized high order dihedral distribution may be applied to the airfoil root and produce the same reduction in airfoil aerodynamic loading.

With continued reference to FIG. 3-6, FIG. 7 illustrates a rotor blade spanwise stacking distribution 48 (in the y'-z coordinate system). The illustrated rotor blade spanwise stacking distribution 48 includes a curve region 110 that diverges from a reference line 120 to create the dihedral angle D at the tip 38. The reference line 120 indicates where the spanwise stacking distribution 48 would be if a straight region 130 of the airfoil 40 extended to the tip 38 of the airfoil 40. The curve region 110 starts at a blend point 112 and extends to the tip 38 along a curve 116. The shape of the curve 116 is defined by a high order polynomial (i.e., a polynomial with an order greater than two). By way of example the shape of the curve region is defined by a polynomial including the term $A*(Z-Z_{blend})^n$, in a more specific example, the shape of the curve region is defined by $\Delta y'=A*(Z-Z_{blend})^n$ where $\Delta y'$ is a displacement of the spanwise stacking distribution in the chordline normal (y') direction (see FIG. 5), A is a constant, Z is the radial location of the spanwise stacking distribution 48 section, $Z_{blend}$ is the radial location for blend point and n is the order of the dihedral. In one example $n>2.1$. In another example $2<n<2.1$. In another example the shape of the curve 116 is defined by a third or higher order polynomial.

By using a high order polynomial to define the curve 116, the blend point 112 can be shifted closer to the tip 38 and/or the tip deflection 114 can be reduced, while achieving the same dihedral angle D as a curve 116 defined by a second order polynomial. Alternatively, the tip deflection 114 can be maintained and a higher dihedral angle D can be achieved. Thus, a high order polynomial defining the shape of the curve region 116 allows the tip displacement 114 for a specified dihedral angle D to be reduced. Reducing the tip displacement 114 provides benefits with regards to: ease of manufacturing, minimizing root stress and/or limiting axial displacement to aid in achieving gapping constrains.

In any given airfoil 40 including a tip 38 with a dihedral angle D, there are three factors that influence the dihedral angle D: the blend point 112, the tip deflection 114, and the shape of the curve 116 in the curve region 110. Shifting the blend point 112 along the span line 48 towards 100% span, increasing the order of the polynomial defining the curve 116, or increasing the tip deflection 114 will all increase the dihedral angle D.

With continued reference to FIGS. 1-7, FIG. 8 illustrates a graph of the spanwise stacking distribution in terms of percent span in the rotated coordinate system (y'-z). A prior art airfoil 210, using a second order polynomial shaped curve 116 in the curve region 110 and a dihedral angle D of approximately 8 degrees has a relatively high tip deflection 114 and a blend point 212 that is near 70% span. A reference radial airfoil 240 with no dihedral angle D (approximately 0 degrees) and no curve region is also illustrated.

An example airfoil 220 with a high order (order n, where n is greater than or equal to 2.1) polynomial shape for the curve 116 with the same tip deflection 114 as the prior art airfoil 210 has a significantly increased tip dihedral angle D of approximately 27 degrees and a blend point 222 that is shifted significantly further toward the tip along the span line 48 than the prior art blade 210. In a similar manner, an airfoil 230 that holds the tip dihedral angle D at approximately 8 degrees, as in the prior art airfoil 210, but includes a higher order polynomial shape 116 for the curve region 110, has a tip deflection 114 that is significantly less than the prior art airfoil tip offset. As with the example airfoil 220, the example airfoil 230 has a blend point 232 that is significantly closer to the tip 38 along the span line 48 than the prior art airfoil 210. In each of the example blades 220, 230, the inclusion of the higher order curve 116 has allowed the tip deflection 114 required to achieve a desired dihedral angle D to be reduced.

In another example, airfoil 40 using a high order shaped polynomial curve region 116 of the spanwise stacking distribution 48, the blend point can be at least 80% span. In further examples, a maximized dihedral angle D in the range of 15 to 35 degrees is achieved without causing excessive tip deflection 114. Similar systems using a second order polynomial curve 116 in the curve region 110 achieve less than a 10 degree dihedral angle D for the same tip deflection.

It is further understood that airfoils designed according to the above description can be incorporated into newly designed turbine machines or existing turbine machines and accrue the same benefits in each.

It is further understood that any of the above described concepts can be used alone or in combination with any or all of the other above described concepts.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A turbomachine blade comprising:

an airfoil extending along a spanwise stacking distribution between a root and a tip region, said airfoil including a chordline extending between a leading edge and a trailing edge; and a dihedral feature of the spanwise stacking distribution, wherein said dihedral feature is generally localized at an end of the spanwise stacking distribution, said dihedral feature being further defined by a curved region of the spanwise stacking distribution of said airfoil, a shape of said curved region being defined by a high order polynomial.

2. The turbomachine blade of claim 1, wherein said high order polynomial is defined by a polynomial comprising the polynomial term $A*(Z-Z_{blend})^n$ where, A is a constant, Z is a radial location of the spanwise stacking distribution section, $Z_{blend}$ is a radial location for a blend point of said spanwise stacking distribution, and n is the order of the polynomial.

3. The turbomachine blade of claim 2, wherein said high order polynomial is defined by $\Delta y'=A*(Z-Z_{blend})^n$.

4. The turbomachine blade of claim 2, wherein n is greater than or equal to 2.1.

5. The turbomachine blade of claim 2, wherein n is greater than or equal to 3.

6. The turbomachine blade of claim 1, wherein said curve region is a region of said airfoil where a spanwise stacking distribution of said airfoil diverges from a radial airfoil stacking line.

7. The turbomachine blade of claim 6, wherein said airfoil further comprises a blend point where said curve region initially diverges from the radial airfoil stacking line.

8. The turbomachine blade of claim 7, wherein said blend point is at least at 70% of said span.

9. The turbomachine blade of claim 8, wherein said blend point is at least at 80% of said span.

10. The turbomachine blade of claim 1, wherein said dihedral angle is in the range of 15 degrees to 35 degrees.

11. The turbomachine blade of claim 1, wherein said airfoil is a rotor blade.

12. The turbomachine blade of claim 11, wherein said airfoil is a rotor blade in a compressor section of a gas turbine engine.

13. The turbomachine blade of claim 1, wherein said airfoil is a stator blade.

14. The turbomachine blade of claim 13, wherein said airfoil is a stator blade in a compressor section of a gas turbine engine.

15. The turbomachine blade of claim 1, wherein said spanwise stacking distribution extends from a root to a tip of said airfoil, and wherein said spanwise stacking distribution is a curve passing through the centroids of each of multiple stacked planar sections of said airfoil.

16. The turbomachine blade of claim 1, wherein said end of the spanwise stacking distribution is a tip region of said airfoil.

17. The turbomachine blade of claim 1, wherein said end of the spanwise stacking distribution is a root region of said airfoil.

18. A turbine machine comprising:

a plurality of airfoils wherein each of said airfoils extends along a spanwise stacking distribution between a root and a tip region, said airfoil including a chordline extending from a leading edge and a trailing edge; and a dihedral feature of the spanwise stacking distribution, wherein said dihedral feature is generally localized at an end of the spanwise stacking distribution, said dihedral feature being further defined by a curved region of the spanwise stacking distribution of said airfoil, a shape of said curved region being defined by a high order polynomial.

19. The turbine machine of claim 18, wherein said high order polynomial is defined by a polynomial comprising the polynomial term $A*(Z-Z_{blend})^n$ where, A is a constant, Z is the radial location of the spanwise stacking distribution section, $Z_{blend}$ is a radial location for a blend point of said spanwise stacking distribution, and n is the order of the polynomial.

20. The turbine machine of claim 19, wherein said high order polynomial is defined by $\Delta y'=A*(Z-Z_{blend})^n$.

21. The turbine machine of claim 20, wherein n is greater than or equal to 2.1.

22. The turbine machine of claim 20, wherein n is greater than or equal to 3.

23. The turbine machine of claim 19, wherein said curve region is a region of said airfoil where a spanwise stacking distribution diverges from a radial airfoil stacking line.

24. The turbine machine of claim 19, wherein said turbine blade further comprises a blend point where said curve region initially diverges from the radial airfoil stacking line.

25. The turbine machine of claim 19, wherein said blend point is at least at 70% of said span.

26. The turbine machine of claim 19, wherein said blend point is at least at 80% of said span.

27. The turbine machine of claim 19, wherein said dihedral angle is in the range of 15 degrees to 35 degrees.

28. The turbine machine of claim 19, wherein said turbine machine is a geared turbofan.

29. The turbine machine of claim 19, wherein said spanwise stacking distribution extends from a root to a tip of said airfoil, and wherein said spanwise stacking distribution is a curve passing through the centroids of each of multiple stacked planar sections of said airfoil.

30. The turbine machine blade of claim 18, wherein said end of the spanwise stacking distribution is a tip region of said airfoil.

31. The turbine machine blade of claim 18, wherein said end of the spanwise stacking distribution is a root region of said airfoil.

* * * * *